US006986714B2

(12) United States Patent
Porper et al.

(10) Patent No.: US 6,986,714 B2
(45) Date of Patent: Jan. 17, 2006

(54) BILLIARDS GAME

(75) Inventors: Joseph Porper, Chatsworth, CA (US); John R. Bryant, 39957 Penina Way, Palmdale, CA (US) 93551

(73) Assignee: John R. Bryant, Palmdale, CA (US)

( * ) Notice: Subject to any disclaimer, the term of this patent is extended or adjusted under 35 U.S.C. 154(b) by 25 days.

(21) Appl. No.: 10/324,712

(22) Filed: Dec. 19, 2002

(65) Prior Publication Data

US 2003/0114235 A1 Jun. 19, 2003

Related U.S. Application Data

(60) Provisional application No. 60/342,041, filed on Dec. 19, 2001.

(51) Int. Cl.
*A63D 15/00* (2006.01)

(52) U.S. Cl. ..... 473/1; 473/4

(58) Field of Classification Search ..... 473/1–4, 473/9, 7, 14, 20, 23; 273/123 R, 126 R
See application file for complete search history.

(56) References Cited

U.S. PATENT DOCUMENTS 3,958,804 A * 5/1976 Godfrey ..... 473/7
4,004,804 A * 1/1977 Gholson ..... 473/14
4,294,449 A * 10/1981 Shaw ..... 273/126 R
4,874,167 A * 10/1989 Hillard ..... 473/14
5,350,171 A * 9/1994 Wozniak ..... 473/1
6,644,662 B1 * 11/2003 Cao et al. ..... 273/123 R

OTHER PUBLICATIONS

The Complete Illustrated Encyclopedia of All The major Sports of the World—Rules of The Game; Snooker—pp. 84 and 85; 1990.*

* cited by examiner

*Primary Examiner*—Mitra Aryanpour
(74) *Attorney, Agent, or Firm*—Kelly Lowry & Kelley, LLP

(57) ABSTRACT

A method for playing a game on a pocket billiards table with a plurality of consecutively numbered billiards balls and a cue ball by at least two players is shown and described. The object of the game is for a single player to sink all of the billiards balls into the pockets of the billiards table in the fewest shots or strokes. The first ball each player attempts to sink in a pocket is the lowest consecutively numbers ball on the table. Each time the lowest consecutively numbered ball is pocketed, the player moves to the next higher consecutively numbered ball which has become the lowest consecutively numbered ball remaining on the table after the previous ball was pocketed.

6 Claims, 3 Drawing Sheets

BILLIARDS GAME

RELATED APPLICATION

This application claims priority from Provisional Application No. 60/342,041, filed Dec. 19, 2001.

BACKGROUND OF THE INVENTION

The present invention generally relates to billiards. More particularly, the present invention relates to a new billiards game which is completely offensive in nature.

There are a variety of billiards games. Perhaps the most popular is referred to as 8-ball, a game played with a cue ball and fifteen object balls, 1 through 15. The object of the game is that one player must pocket balls of the group numbered 1–7 (solid colors), while the other player has 9–15 (stripes). The balls are racked in a triangle at the foot of the billiards table with the "8" ball in the center of the triangle, and the first ball of the rack on the foot spot, a striped ball in one corner of the rack and a solid ball in the other corner. One of the players then has the option to break the racked balls. The table is "open" when the choice of groups (stripes or solids) has not been determined. The table is always open immediately after the break shot, and the choice of group is determined only when the player legally pockets an object ball after the break shot. The player pocketing his group first, and then legally pocketing the 8-ball wins the game.

Professional tournaments typically use the 9-ball format, wherein the balls are racked in a diamond shape, with the 1-ball at the top of the diamond and the 9-ball at the center of the diamond. The rest of the balls can be placed in random order. The break must hit the 1-ball first and cause at least four of the balls to hit the side rails. On each shot throughout the game the cue ball must make contact with the lowest numbered ball on the table before touching any other ball. The balls do not need to be pocketed in order, but the lowest numbered ball must be struck first before any other ball is touched. If you hit the lowest numbered ball first, and pocket another ball, it remains returned until you foul, hit another ball in, or hit the 9-ball in to win the game. After a miss, the incoming player must shoot from the position left by the previous player. However, after any foul, the incoming player may start with the cue ball anywhere on the table. The game ends when a player sinks the 9-ball in any pocket.

Every billiards game that the inventors are aware of include at least two players playing against one another. This creates defensive strategies of "hiding" the cue ball or the ball that should be struck next if it is not feasible to sink your own ball in anticipation that the other player will have difficulty with your cue ball location. Although adding a layer of skill to the games, it has been found that such games can be complicated for a viewer to watch, or excessively long or boring. Although it is estimated that over thirty-seven million people in the United States play pool at least once a year, very few of those bother watching the sport on television. It is believed that this is due to the slow pace and complicated rules involved in the traditional formats.

Accordingly, there is a continuing need for a new pool or billiards game having a fast pace and relatively simple rules. What is also needed is a billiards game which is completely offensive in nature to achieve these objectives. The present invention provides these needs and other related advantages.

SUMMARY OF THE INVENTION

A method for playing billiards is illustrated and described that provides a fast pace and relatively simple rules. This method provides a billiards game which is completely offensive in nature in that the object of the game is for a single player to sink all of the billiards balls into the pockets of the billiards table in the fewest shots or strokes. The first ball each player attempts to sink in a pocket is the lowest consecutively numbers ball on the table. Each time the lowest consecutively numbered ball is pocketed, the player moves to the next higher consecutively numbered ball which has become the lowest consecutively numbered ball remaining on the table after the previous ball was pocketed.

A player begins the game by placing the consecutively numbered balls in a predetermined pattern on a surface of the table. The player then places the cue ball anywhere on the table. The player uses a cue stick to strike the cue ball and move the cue ball towards the lowest consecutively numbered ball on the table. Each strike of the cue ball by the cue stick is counted.

The player then moves on to striking the next consecutively numbered ball with the cue ball so long as both the previously lowest consecutively numbered ball on the table entered any of the pockets of the table. The games continues until every billiards ball has been pocketed.

As with any game, penalties may be incurred. For example, a one stroke penalty is added to the player's tally if the player sinks the cue ball into one of the pockets. The cue ball is then returned to the surface of the table and placed in a position determined by the location of the lowest consecutively numbered ball on the table. A two stroke penalty may be incurred if the player, during a single shot, fails to sink the lowest consecutively numbered ball on the table but does pocket any of the other billiards balls remaining on the table.

Each player takes their turn sinking the consecutively numbered billiards balls into the pockets. The number of strikes made by each player is tallied, and the player with the lowest number of strikes is declared the winner.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
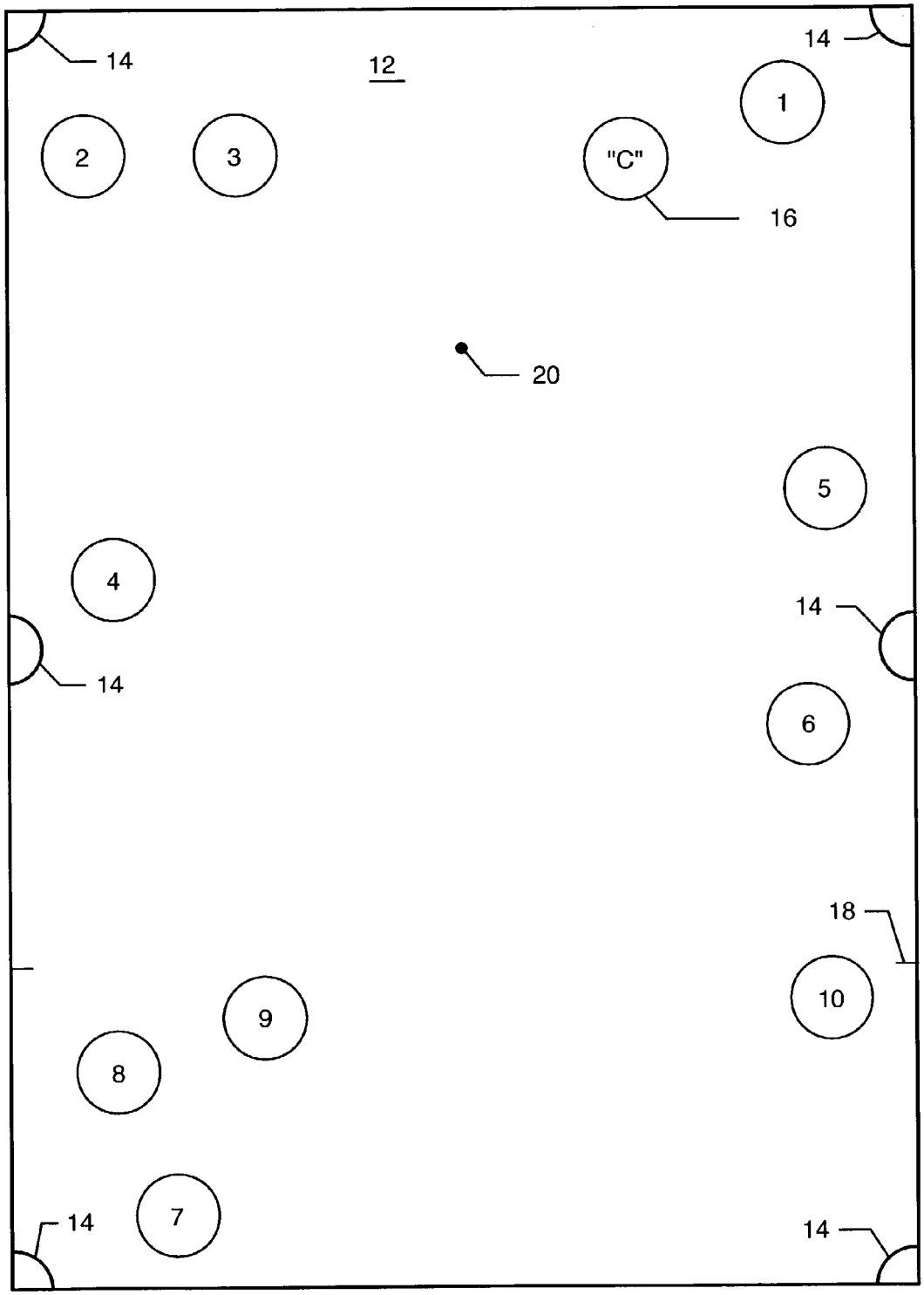
FIG. 1 is a schematic illustration of initial placements of ten billiards balls and a cue ball on a billiards table in accordance with the present invention.

As shown in the drawings for purposes of illustration, the present invention resides in a new billiards game which is completely offensive in design.

With reference to FIG. 1, in a particularly preferred embodiment ten billiards balls (1–10) are placed on a billiards table 12 having pockets 14 in the traditional manner sized to receive the billiard balls 1–10. It is the object of the game for a single player to sink all of the billiards balls 1–10 into the pockets 14 of the billiards table 12 in the fewest shots or strokes.

In accordance with the present invention, the player has the cue ball 16 placed in hand a spot on the table according to the predetermined pattern for that particular game. Due to the fact that the "1" billiards ball must be struck and sunk into a pocket 14 first, the player will typically align the cue ball 16 with the "1" ball, as illustrated in FIG. 1. This is considered to be a "free" shot. If the player is successful in sinking the "1" ball on a single shot, the player must strike the cue ball 16 with the cue stick in traditional manner in an attempt to sink the "2" ball. If the player requires two strikes or hits of the cue ball 16 in order to sink the "2" ball, the strikes are tallied against the player. If the player is attempting to sink the "2" ball, but in the process not only sinks the "2" ball, but one or more other balls 3–10, this is considered to be a "bonus", or an "ace" even if the balls are sunk out of order. The player then proceeds to play the game by sinking the lowest number ball to the highest number ball to complete the game.

However, if the player inadvertently sinks the cue ball 16 into one of the pockets 14, this is considered a scratch, and is given a one stroke penalty. The cue ball 16 then must be placed behind the "head string" line 18 on the head string spot if the ball is on the far end of the table as dictated by the side pockets. Alternatively, if the ball to be struck and sunk is behind the side pockets towards the head string 18, the player may place the cue ball 16 behind the foot spot 20, which is typically reserved for racking the balls in other billiards games. Relief is provided if an object ball happens to be on the head or foot spot by allowing the cue ball to be placed to the side of the spot. If the player is attempting to strike and hit, for example, the "2" ball, but instead only hits and sinks another ball, such as the "3" ball and sinks the "3" ball, the player is assessed a two stroke penalty, but the "3" ball will remain in the pocket.

Figure 3:
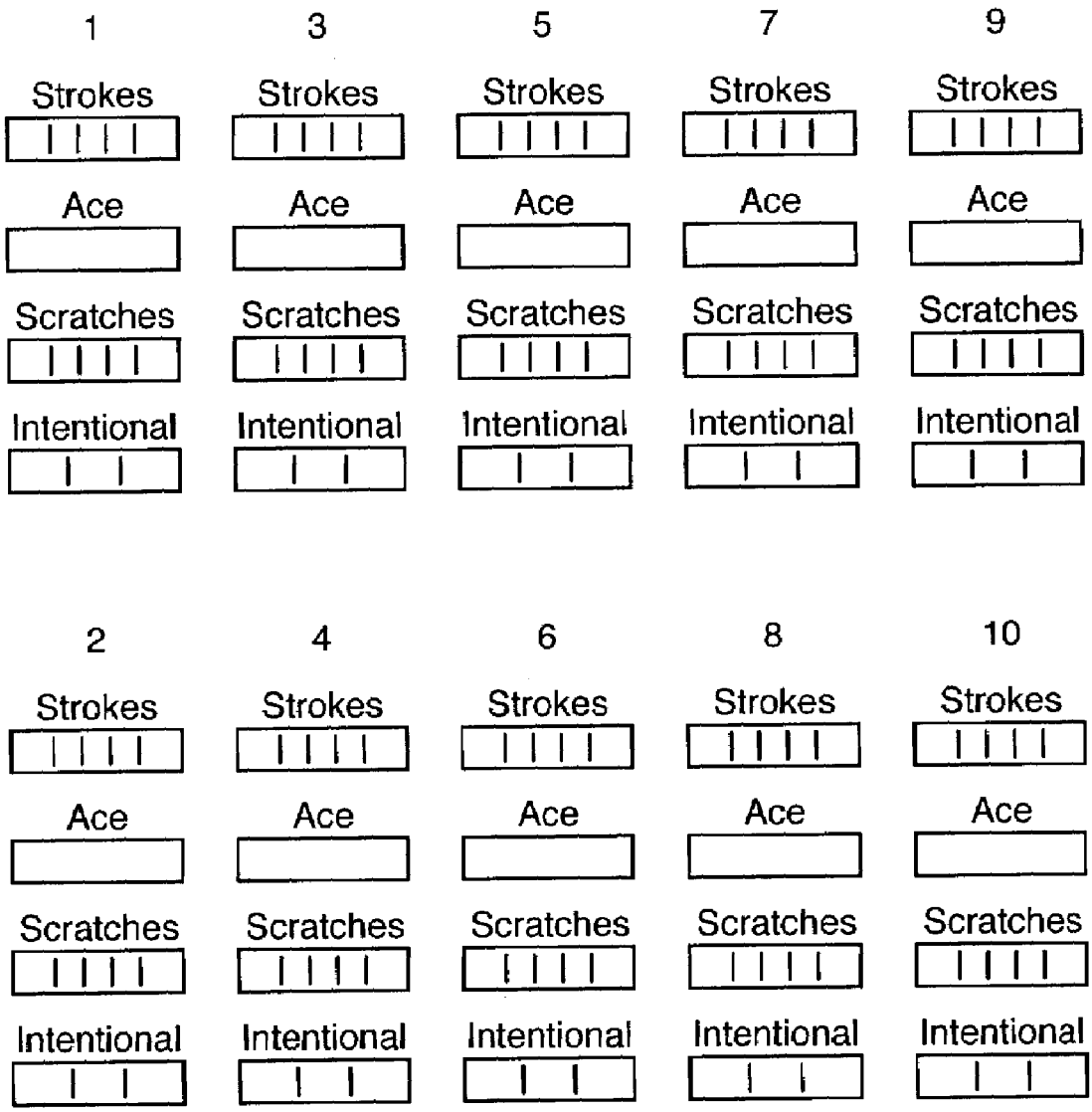
FIG. 3 is an illustration of an exemplary score card used in the present invention.

This process continues with the tallying strokes and scratches as shown on the tally sheet of FIG. 3.

After a first player finishes sinking all balls 1–10 into the billiards table pockets 14, the balls 1–10 are placed onto their markings and a second player proceeds in the same manner. The player having the least amount of overall strikes wins. It will be appreciated by those skilled in billiards that only very skilled billiards players will be able to sink all ten balls 1–10 in ten strikes or less. Typically, it will take many more strikes than 10 in order to sink all of the balls 1–10.

Figure 2:
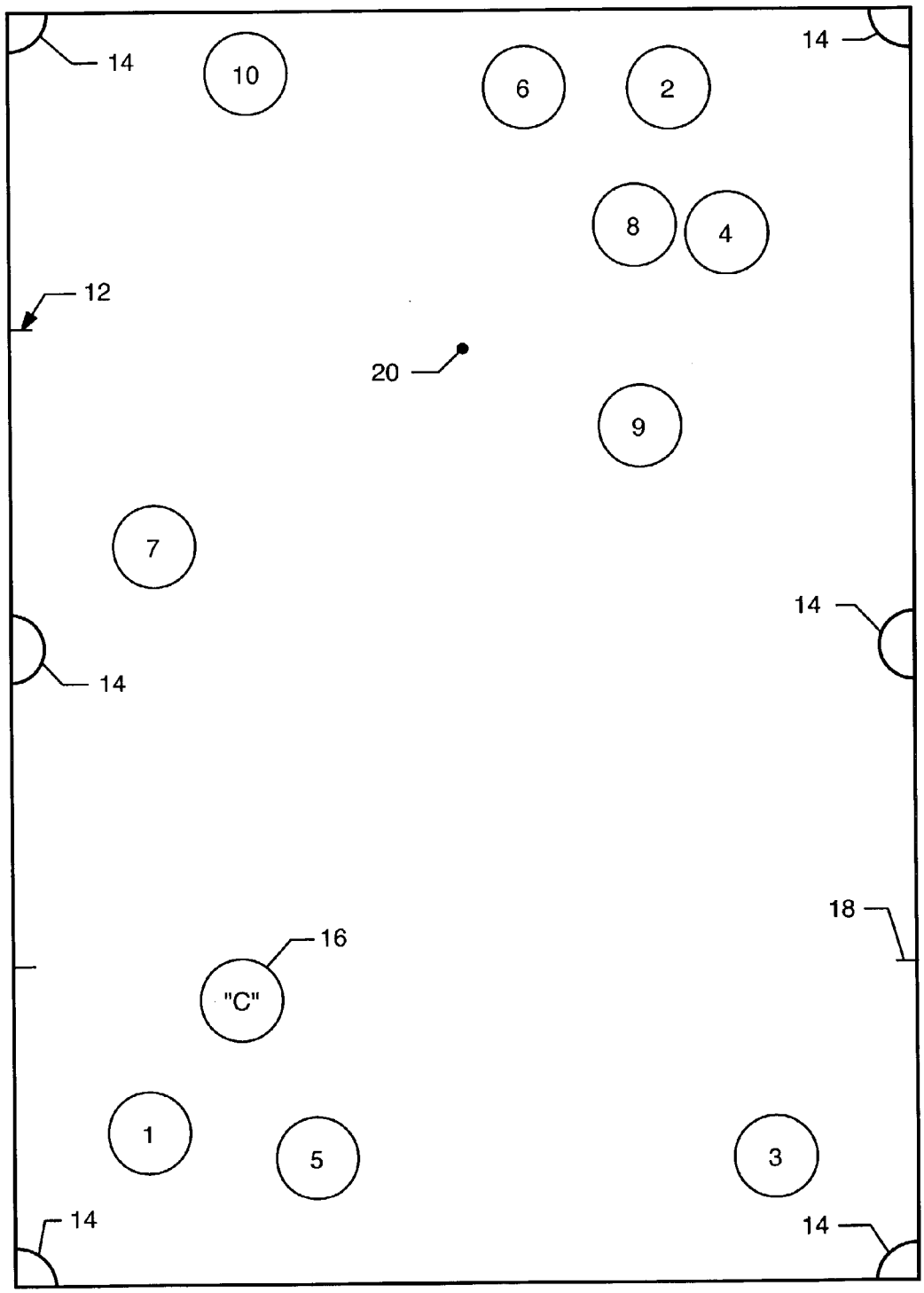
FIG. 2 is a schematic illustration of another predetermined arrangement of ten balls and a cue ball on a billiards table in accordance with the present invention.

With reference to FIGS. 1 and 2, there are different layouts, or set patterns, for a tournament setting, or players playing on multiple billiards tables 12. For example, a predetermined arrangement may be placed on one table and another set pattern or predetermined arrangement on another table. The patterns may be designated by placing stickers or markings on the table representing the initial set-up pattern. Thus, when a player has completed a game on a given table, the player advances to a second table to play the same game with a different starting pattern. The rotation proceeds until the predetermined number of games have been completed. Such games can be determined by the holder of the tournament and be based upon the number of tables available, or the time period slated for the tournament, particularly if the tournament is being televised. The set patterns of the games can be altered to increase or decrease the difficulty to accommodate both amateur and professional players. In a tournament setting, there may be a cut-off point at a second round where a predetermined portion of the players will be eliminated, or a cut-off point where every round a quarter of the field will be eliminated for the first three rounds, whereas otherwise determined by the tournament. In this manner, the field of players can be narrowed to the two best players who compete in a rotation as described above. Tournaments can also be established between cities wherein a predetermined number of tables having a predetermined set pattern is used in Los Angeles, for example, and another set of patterns are used in Las Vegas, for example, with the players rotating among cities, or winners of particular cities advancing to other rounds.

It will be appreciated by the reader that although a ten ball format has been described and illustrated, the number of balls may actually be less or greater. For example, only a few balls, or up to fifteen, can be placed on the table in a preset pattern. The player would proceed in the game by the rules described above and eventually sink all balls on the table while tallying strikes, aces, and scratches. It is believed that this purely offensive style billiards game would bring an excitement to the billiards field in general and be more prone to a television audience as they rules are relatively intuitive and straightforward, the game fast paced, and the viewer can imitate the game by playing the same game on his or her own billiards table, or even on a computerized game or the like.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A method of playing a game on a pocket billiards table with a plurality of consecutively numbered billiards balls and a cue ball by at least two players using at least one cue stick, comprising the steps of:

(A) placing the consecutively numbered balls in a predetermined pattern on a surface of the table;

(B) a first player placing the cue ball anywhere on the table;

(C) the first player moving the cue ball towards the lowest consecutively numbered ball on the table by striking the cue ball with the cue stick until the lowest consecutively numbered ball is entered into any pocket of the table, wherein each strike of the cue ball by the cue stick is counted;

(D) the first player moving the cue ball towards the next consecutively numbered ball so long as both the immediately previous movement of the cue ball caused the previously lowest consecutively numbered ball on the table to enter any of the pockets of the table and there is at least one billiards ball remaining on the table;

(E) the first player repeating steps (C) through (D) without alternating with another player until no billiards ball, with the exception of the cue ball, remains on the surface of the table;

(F) tallying the total strikes made by the first player in order to pocket all of the billiards balls;

(G) after the first player has moved all of the billiards balls, with the exception of the cue ball, into the pockets of the table, placing the consecutively numbered balls in the predetermined pattern on the surface of the table;

(H) a second player placing the cue ball anywhere on the table;

(I) the second player moving the cue ball towards the lowest consecutively numbered ball on the table by striking the cue ball with the cue stick until the lowest consecutively numbered ball is entered into any pocket of the table, wherein each strike of the cue ball by the cue stick is (J) the second player moving the cue ball towards the next consecutively numbered ball so long as both the immediately previous movement of the cue ball caused the previously lowest consecutively numbered ball on the table to enter any of the pockets of the table and there is at least one billiards ball remaining on the table;

(K) the second player repeating steps (I) through (J) without alternating with another player until no billiards ball, with the exception of the cue ball, remains on the surface of the table;

(L) tallying the total strikes made by the second player in order to pocket all of the billiards balls; and (M) comparing the total strikes of the first and second players to determine a winner.

2. The method of claim 1, including the step of:

(N) adding a predetermined stroke penalty if the player sinks the cue ball into one of the pockets.

3. The method of claim 2, including the step of:

(O) placing the cue ball in a predetermined position depending on the location of the lowest consecutively numbered ball on the table after sinking the cue ball into one of the pockets.

4. The method of claim 3, including the step of:

(P) adding a predetermined stroke penalty if the player sinks into one of the pockets a billiards ball other than the lowest consecutively numbered ball on the table but does not sink the lowest consecutively numbered ball.

5. The method of claim 4, including the steps of:

the first player repeating steps (A) through (D) and (N) through (P) without alternating with another player until no billiards ball remains on the surface of the table, and then the second player repeating steps (G) through (J) and (N) through (P) without alternating with another player until no billiards ball remains on the surface of the table.

6. A method of playing a game on a pocket billiards table with a plurality of consecutively numbered billiards balls and a cue ball by at least two players using at least one cue stick, comprising the steps of:

(A) placing the consecutively numbered balls in a predetermined pattern on a surface of the table;

(B) a first player placing the cue ball anywhere on the table;

(C) the first player moving the cue ball towards the lowest consecutively numbered ball on the table by striking the cue ball with the cue stick until the lowest consecutively numbered ball is entered into any pocket of the table, wherein each strike of the cue ball by the cue stick is counted;

(D) the first player moving the cue ball towards the next consecutively numbered ball so long as both the immediately previous movement of the cue ball caused the previously lowest consecutively numbered ball on the table to enter any of the pockets of the table and there is at least one billiards ball remaining on the table;

(E) adding a predetermined stroke penalty if the first player sinks the cue ball into one of the pockets, and placing the cue ball in a predetermined position depending on the location of the lowest consecutively numbered ball on the table;

(F) adding a predetermined stroke penalty if the first player sinks into one of the pockets a billiards ball other than the lowest consecutively numbered ball on the table but does not sink the lowest consecutively numbered ball;

(G) the first player repeating steps (C) through (F) without alternating with another player until no billiards ball, with the exception of the cue ball, remains on the surface of the table;

(H) tallying the total strikes made by the first player in order to pocket all of the billiards balls;

(I) after the first player has moved all of the billiards balls, with the exception of the cue ball, into the pockets of the table, placing the consecutively numbered balls in the predetermined pattern on the surface of the table;

(J) a second player placing the cue ball anywhere on the table;

(K) the second player moving the cue ball towards the lowest consecutively numbered ball on the table by striking the cue ball with the cue stick until the lowest consecutively numbered ball is entered into any pocket of the table, wherein each strike of the cue ball by the cue stick is counted;

(L) the second player moving the cue ball towards the next consecutively numbered ball so long as both the immediately previous movement of the cue ball caused the previously lowest consecutively numbered ball on the table to enter any of the pockets of the table and there is at least one billiards ball remaining on the table;

(M) adding a predetermined stroke penalty if the second player sinks the cue ball into one of the pockets, and placing the cue ball in a predetermined position depending on the location of the lowest consecutively numbered ball on the table;

(N) adding a predetermined stroke penalty if the second player sinks into one of the pockets a billiards ball other than the lowest consecutively numbered ball on the table but does not sink the lowest consecutively numbered ball;

(O) the second player repeating steps (K) through (N) without alternating with another player until no billiards ball, with the exception of the cue ball, remains on the surface of the table;

(P) tallying the total strikes made by the second player in order to pocket all of the billiards balls; and (Q) comparing the total strikes of the first and second players to determine a winner.

* * * * *

UNITED STATES PATENT AND TRADEMARK OFFICE

CERTIFICATE OF CORRECTION

PATENT NO. : 6,986,714 B2
DATED : January 17, 2006
INVENTOR(S) : Joseph Porper and John R. Bryant It is certified that error appears in the above-identified patent and that said Letters Patent is hereby corrected as shown below:

Column 5,
Line 6, insert -- counted; -- after "is".

Signed and Sealed this

Eighteenth Day of April, 2006

JON W. DUDAS
*Director of the United States Patent and Trademark Office*